US005513419A

United States Patent [19]

Zinger

[11] Patent Number: 5,513,419

[45] Date of Patent: May 7, 1996

[54] SHOWER CURTAIN ROD ASSEMBLY

[76] Inventor: John E. Zinger, 812 N. 3rd St., Reading, Pa. 19601

[21] Appl. No.: 191,107

[22] Filed: Feb. 3, 1994

[51] Int. Cl.[6] ..... A47K 3/14

[52] U.S. Cl. ..... 16/87.4 R; 16/95 R; 4/610

[58] Field of Search ..... 16/87, 87.2, 87.4 R, 16/87.6 R, 94 D, 95 D, 96 D; 4/608–610; 160/123, 124, 126, 330, 345, DIG. 3

[56] References Cited

U.S. PATENT DOCUMENTS

| | | | |
|---|---|---|---|
| 2,778,030 | 1/1957 | Goche | 16/87.4 R |
| 4,461,056 | 7/1984 | Solinski | 16/87.4 R |
| 4,769,862 | 9/1988 | Skreelowski | 4/607 |
| 5,187,759 | 3/1993 | Poore | 16/87.4 R |
| 5,426,821 | 6/1995 | Story | 16/87.4 |

*Primary Examiner*—Maurina T. Rachuba

*Assistant Examiner*—Kenneth J. Hansen

*Attorney, Agent, or Firm*—John D. Gugliotta

[57] ABSTRACT

A Shower Curtain Rod Assembly includes a stem-to-stem, double-Y shaped shower curtain rod with an integral split-track extending along almost the entire length of its bottom surface, shower curtain clips and screw-type endcaps. The shower curtain rod is suspended between two side walls of a shower or bathtub enclosure by unscrewing the endcaps. Rubber or plastic endcap pads prevent the shower curtain rod from slipping and protect the side walls from damage from preasure mounting. Shower curtain clips include an elongated base, a stem and ring-type clamps for suspending shower curtain(s) from the shower curtain rod. The base can thereby be inserted into the split-track and rotatingly secured. Conventional shower curtain(s) can be secured using the ring-type clamps. This allows the shower curtain to be moved to optimal positions for redirecting water into a shower or bathtub basin, to enhance the bathroom decor when the shower is not in use and to move the shower curtain out of the way while the basin is being cleaned.

5 Claims, 3 Drawing Sheets

SHOWER CURTAIN ROD ASSEMBLY

BACKGROUND OF THE INVENTION

1. Field of Invention

The invention relates to plumbing accessories in general and rods and poles in particular.

2. Description of the Prior Art

Shower Curtain Rod Assemblies are typically used to suspend one or more shower curtains such that an elongated bathtub or shower basin is surrounded on all sides: in the rear by a fixed back wall; on both sides by fixed side walls; and in front by one or two moveable shower curtains. In the most common configuration, the basin has an essentially flat outer side surface, an essentially flat horizontal lip and an oval-shaped inner side surface that narrows with increased depth. In addition, the side walls are essentially flat and abut the lip of the basin at right angles. Existing shower curtain rod assemblies include a straight tubular rod affixed at each end to a side wall above the lip of the basin and hooks for suspending a shower curtain moveably along its length. The bottom portion of a suspended shower curtain can thus be lifted inside the basin to contain water during use, lifted outside the basin for cosmetic purposes during non-use or moved toward a side wall for cleaning the basin.

The functional requirements of the walls, shower curtain rod assembly and shower curtain(s) combination are many fold. As a water retaining system, the combination is intended to direct escaping water into the basin while the shower or bathtub is in use. As part of the decor of a bathroom, the exposed ends of the side walls, if any, the shower curtain rod assembly and the shower curtain are typically intended to hide an untidy basin area and to provide an unobtrusive, easily updated, traditional look. As a moveable barrier in a wet, slippery area, the shower curtain is intended to be easily moveable as needed and to add no inherent danger to users of the bathtub, shower or other areas of the bathroom. Finally, the combination must be as inexpensive as possible.

The primary disadvantage of such a combination is that, while it meets other functional requirements, it fails to adequately redirect water into the basin. The inherent weight of the shower curtain acts to drag the bottom end of the shower curtain away from the side walls along the curved inner side surface of the basin. This forms a gap between the shower curtain, the side walls and the lip of the basin through which water can escape to other bathroom areas.

Various attempts to either replace or fortify the above combination have been unsuccessful.

Substituting a glass shower door and metal framing structure for the assembly and shower curtain(s) precludes formation of a gap through which water can escape. It is also consistent with a traditional decor. However, it is also relatively expensive, essentially permanent and poses a risk of serious injury due to sharp door edges, collisions with an open door and broken glass in the basin and other bathroom areas.

A wall covering, commonly referred to in the plumbing industry as "surround", can be affixed to the side walls. Surround can be molded such that it extends outward from the side walls in front of the lip of the basin and blocks the gap. However, it is relatively expensive, essentially permanent, non-traditional looking and adds to the number of slippery surfaces that must be navigated to enter or exit the basin.

Attempts to fortify the water-blocking ability by "locking" the ends of the shower curtain against the side walls have also been unsuccessful. One attempt, adding weight to the bottom of the shower curtain(s), merely increases slippage along the curved inner surface of the basin, thereby actually increasing the gap. A second attempt, adding an adhesive or locking mechanism to the shower curtain and side walls, requires additional effort in moving the shower curtain; this increases the chances of the user slipping while standing in the wet basin. In addition, adding any "sophistication" to the operation of a barrier poses potential difficulty for children and the typical less than fully coherent adult users.

Accordingly, there is a need for a Shower Curtain Assembly that retains each of the functional, cost saving, safety and cosmetic benefits of utilizing an unobstructed, suspended shower curtain. Such an assembly must also provide sufficient lifting capability and a means for effectively containing water within a shower or bathtub basin.

SUMMARY OF THE INVENTION

An object of the invention is to provide a Shower Curtain Rod Assembly that allows conventional shower curtains to be easily manipulated between an effective water containing position for shower or bathtub use and an unobtrusive, cosmetically appealing position for periods of non-use. Such functionality is achieved without requiring obstructive means to affix the shower curtain(s) to either the inner surface of the shower or bathtub basin or to the walls surrounding the basin at either end. In addition, such functionality is achieved simply by moving the shower curtain in a conventional manner.

A second object of the invention is to provide a Shower Curtain Rod Assembly that provides sufficient support strength for suspending one shower curtain against the inner surface of a bathtub basin and a second shower curtain against the outer surface of the basin.

A third object of the invention is provide a Shower Curtain Rod Assembly that is easily installed and removed with minimal damage to supporting walls as a replacement for existing Shower Curtain Rod Assemblies.

These and other features, objects and advantages of the invention can best be understood by reference to the following description thereof together with the drawings.

DETAILED DESCRIPTION OF THE PREFERRED EMBODIMENT

Figure 1:
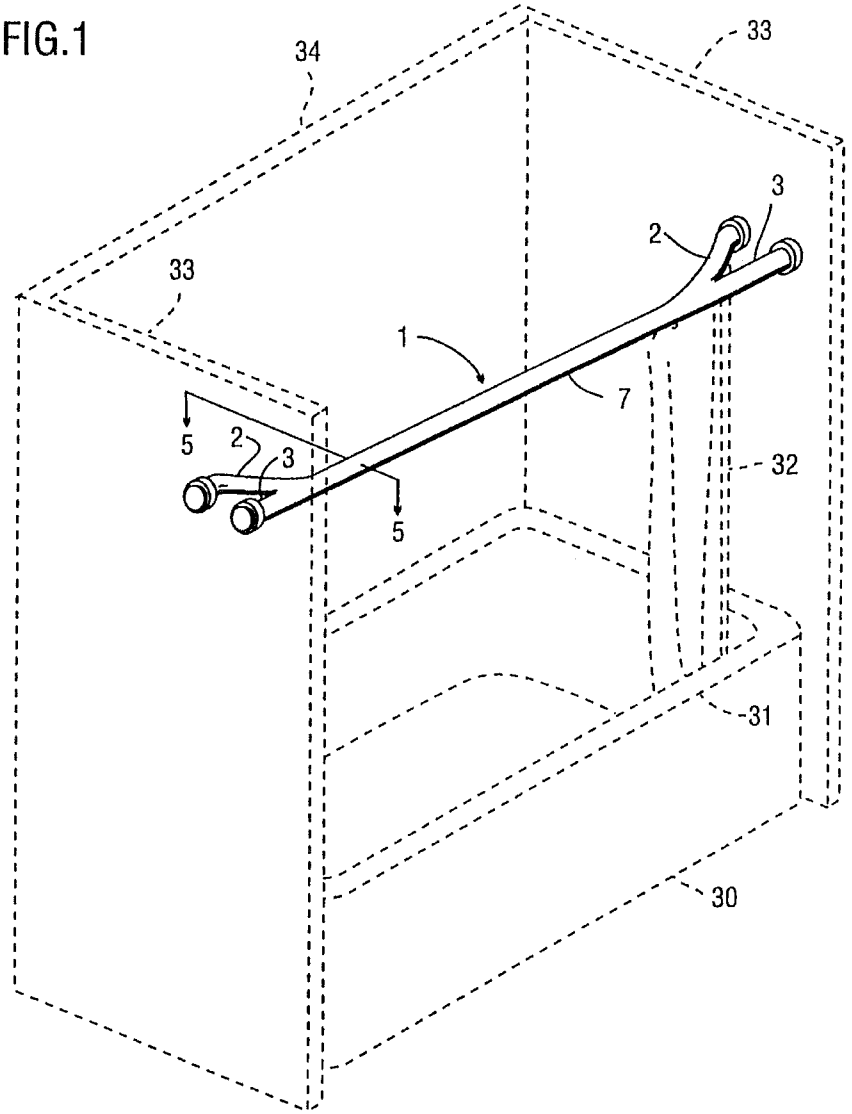
FIG. 1 is a perspective view of the Shower Curtain Rod Assembly showing its integration into an environmental structure of a conventional shower or bathtub alcove and associated shower curtain, which environmental structure is shown in broken lines.

Referring to the drawings, the present invention is shown generally in FIG. 1 and more specifically in FIGS. 2 through 7*b*.

FIG. 1 shows generally how the Shower Curtain Rod Assembly 1 is affixed over the front lip 31 of an elongated bathtub or shower basin 30 and one or more conventional shower curtains 32 are suspended from the Assembly 1. The Assembly 1 is affixed to two side walls 33 which, along with a back wall 34, form an alcove that surrounds the basin 30 on three sides. A shower curtain 32 suspended from the Assembly 1 extends from the Assembly into a typically oval-shaped inner surface of the basin 30 such that escaping water will be deflected by the shower curtain 32 into the basin 30 while the shower or bathtub is in use. A second shower curtain (not shown) can also be suspended from the Assembly 1 such that the second shower curtain extends over the outer surface of the basin 30 primarily for cosmetic purposes.

FIGS. 2 through 5 show how a double Y-shaped configuration and an integral split-track design provide a symetrical and therefore low cost Assembly with a number of functional improvements as compared with a conventional Assembly.

Figure 2:
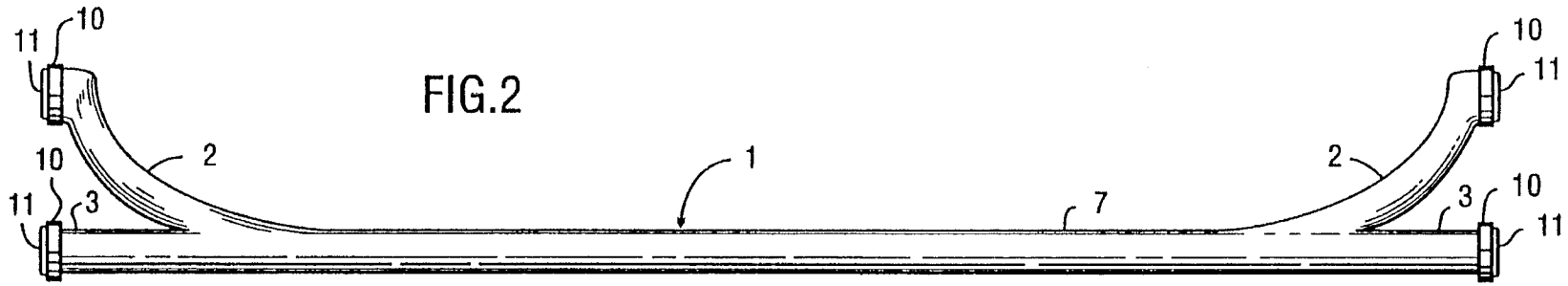
FIG. 2 is a top plan view thereof with the environmental structures removed for clarity.

First, the Y-extensions 2 shown in FIGS. 1 and 2 are shaped and positioned such that they follow the typical contour of the typically oval-shaped inner surface of the conventional elongated bathtub or shower basin 30 shown in FIG. 1. A preferred embodiment of the shape of the Y-extension 2 is an S-shaped pattern wherein the Y-extensions 2 diverge in a split path from a main rod 7 in an S-shaped curve relative to the main rod 7. In addition, a split-track 4 extends along the underside of the main rod 7, Y-extensions 2 and straight ends 3 such that the split-track 4 splits in a V-shaped pattern at an intersection of the Y-extensions 2 and the straight ends 3. This allows a shower curtain suspended from the Assembly 1 to be easily moved among various functional positions.

Figure 3A:
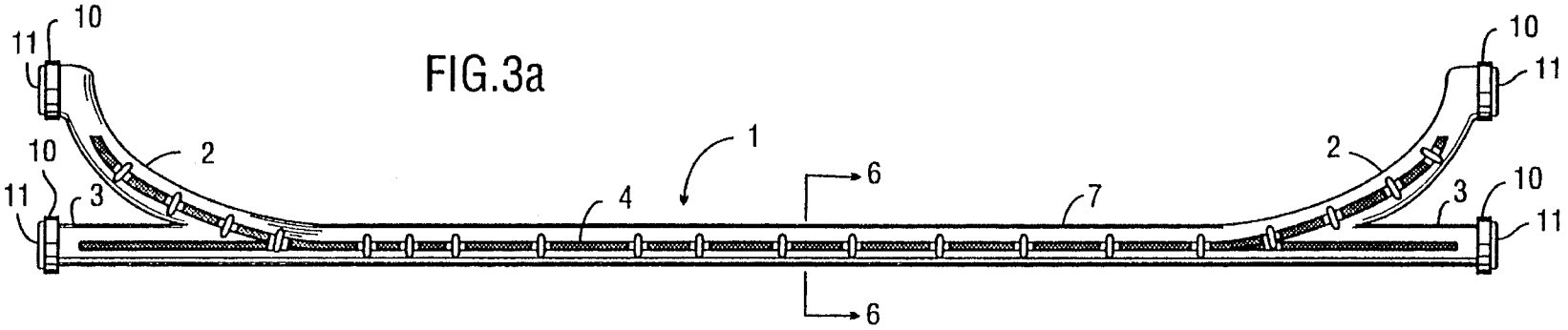
FIG. 3*a* is a bottom plan view thereof showing the general positioning of the shower curtain clips in a water containing position.
Figure 3B:
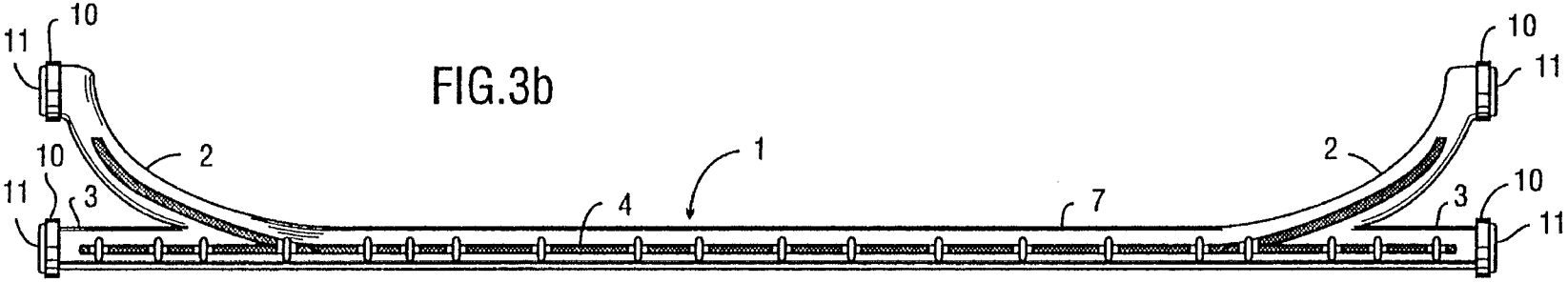
FIG. 3*b* is a bottom plan view thereof showing the general positioning of the shower curtain clips in a non water containing position.

As FIG. 3*a* shows, while a bathtub or shower is in use, a shower curtain can be extended along the split-track 4 to the end of the Y-extension 2 at either one or both ends of the Assembly 1. A shower curtain so positioned and extending along the inner surface of a similarly shaped basin will effectively deflect water into the basin. As FIG. 3*b* shows, a shower curtain can alternatively be extended along the split-track 4 to the straight ends 3 and positioned outside the basin for aesthetic purposes when the bathtub or shower is not in use. FIG. 1 shows a shower curtain moved along the split-track toward a side wall 33 for cleaning the basin.

Figure 4:
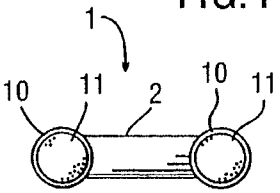
FIG. 4 is side elevation view of the Shower Curtain Rod Assembly showing the shower curtain rod assembly mounting hardware.
Figure 5:
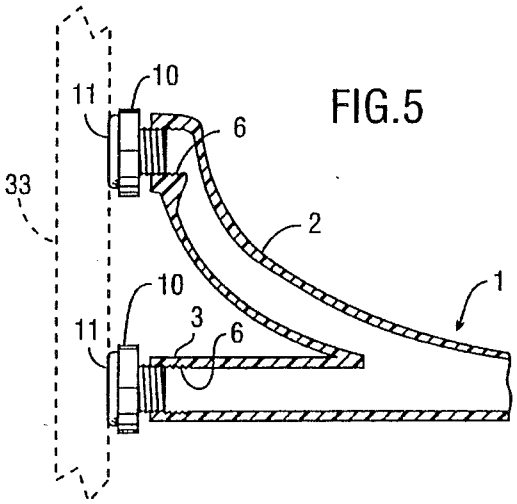
FIG. 5 is a cross sectional, partial cutaway view of the Shower Curtain Rod Assembly taken along line 5—5 of FIG. 1, showing how the mounting hardware is utilized.

The addition of the Y-extension 2 also effectively doubles the surface area of the Assembly 1 coming into contact with the side walls 33 (FIG. 4). FIGS. 4 and 5 further show the addition of an easy, non-destructive means for securing the Assembly 1 to side walls 33. The ends of the tubular Assembly 1 include an integral threaded portion 6 along its inner surface and endcaps 10. Each endcap 10 is similarly threaded such that the endcaps 10 can be extended toward the respective side wall 33 during installation and extended toward the Assembly 1 for removal. In addition, only the rubber end 11, also referred to as a wall protector of each endcap 10 comes into contact with a side wall 33, thereby better securing the Assembly 1 in place and at the same time protecting the side wall 33. The rubber end 11, referred to as the wall protector, is essentially flat and may be composed of another skid resistant material, such as plastic, for instance.

Figure 6:
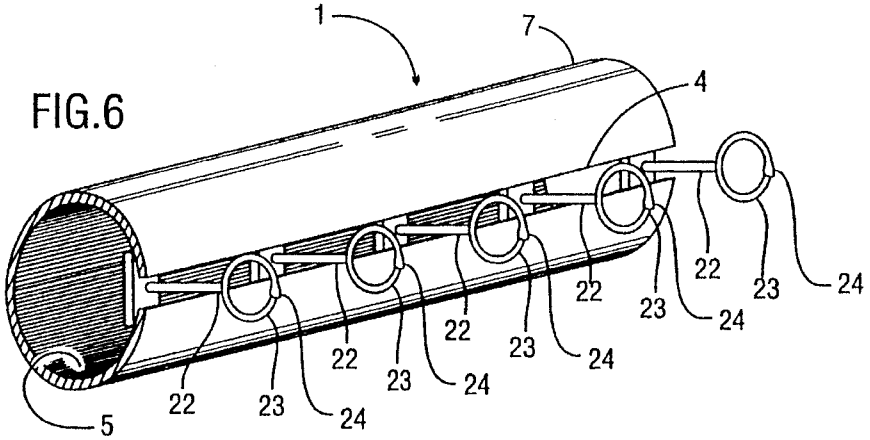
FIG. 6 is a partial perspective, cross sectional view taken along line 6—6 of FIG. 3*a* showing the clip mechanism for attaching a shower curtain to the shower curtain rod assembly.
Figure 7A:
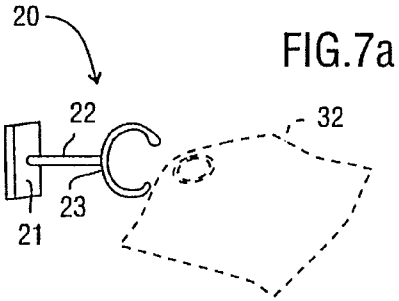
FIG. 7*a* is a perspective view of the replaceable shower curtain clips in an open position.
Figure 7B:
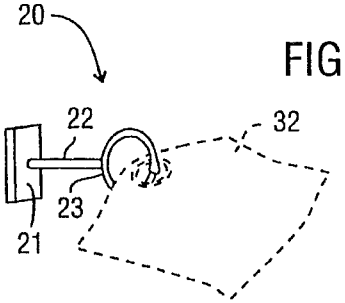
FIG. 7*b* is a perspective view of the replaceable shower curtain clips in a locking position.

FIGS. 6 through 7*b* show how conventional shower curtain(s) can be affixed to the Assembly 1. Specially designed clips 20 are inserted into the split-track 4. The elongated shape of the clip base 21 allows the clips 20 to be inserted and then rotated into a securing position essentially perpendicular to the split-track 4; affixing the shower curtain 32 further secures the clips 20 in place. The clip stems 22 are of sufficient length that the top end of an affixed shower curtain 32 will move unobstructed along the split-track 4 (FIG. 6). A preferred embodiment of the clip 20 is a split ring, as shown in FIG. 7*a*. With a split ring embodiment, ring ends 24 of the clip rings 23 can be pulled apart (FIG. 7*a*) for slipping the shower curtain(s) 32 over the clip ring 23 and then closed (FIG. 7*b*) to secure the shower curtain(s) 32 in place. Another preferred embodiment of the clips 20 is hooks (not shown) over which the shower curtain(s) 32 may be slipped. Another preferred embodiment of the clips 20 is clamps (not shown) which grip the shower curtain(s) 32 in a clamping or pinching manner.

While the above description contains many specificities, these should not be construed as limitations on the scope of the invention, but rather as an example of the preferred embodiment thereof. Many other variations are possible.

One example is that the Y-extensions 2 and rubber ends 11 add sufficient slip resistant surface area that the endcaps 10 can also be forced toward the side walls 33 utilizing a spring-loaded mechanism within each end of the Assembly 1. Conventional bolting brackets can also be used. In addition, the Assembly can be suspended from surrounding walls or support poles to accommodate older, free-standing bathtub basin side walls.

A second example is the use of a trackless rod and conventional shower curtain rings as opposed to the split-track design described above. The disadvantage of such a design however, is that an inner shower curtain as well as an outer shower curtain are required. In addition, the shower curtains can only be opened to the point at which the Y-extensions 2 and straight ends 3 meet, thereby limiting convenience for cleaning of the basin 30.

Finally, the tubular structure of the Assembly 1 provides sufficient volume for the addition of a mechanism for "automatically" opening and closing the shower curtain(s) into any of the above positions.

I claim:

1. A Shower Curtain Rod Assembly having an inner surface from which to hang a conventional shower curtain within an alcove, which alcove is formed by a back wall and two side walls that collectively surround a conventional shower or bathtub basin on three sides, wherein the conventional shower or bathtub basin has a generally oval-shaped inner surface and a front lip, the Shower Curtain Rod Assembly comprising:

a tubular shower curtain rod having an inner surface, an outer surface, an integral main bar, a plurality of integral straight extensions and a plurality of integral Y-extensions, the main bar being cylindrical and having two main ends, each straight extension and Y-extension having a wall end, each integral straight extension and Y-extension pair extending outwardly from a main end of the main bar, each straight extension extending along the longitudinal axis of the main bar, each Y-extension extending curvingly in essentially an S-shaped pattern and essentially the same horizontal plane as the main bar, the wall ends of each straight extension and Y-extension pair being in the same vertical plane such that each straight extension and Y-extension pair can be affixed to a side wall of the alcove surrounding the bathtub basin through equivalent mounting means, the inner surface and outer surface of the shower curtain rod defining a narrow continuous track opening below the shower curtain rod, parallel to its center axis and extending through the length of the main bar and splitting in essentially a V-shaped pattern whereby the track extends through nearly the entire length, of each straight extension and each Y-extension;

mounting means for affixing the wall ends of the straight extensions and Y-extensions to a side wall of the alcove surrounding the bathtub basin; and hanging means for suspending the conventional shower curtain from the shower curtain rod assembly such that the shower curtain can be easily extended lengthwise along the shower curtain rod assembly whereby the shower curtain contains water within the generally oval-shaped surface of the conventional shower or bathtub basin during use of the basin, whereby the shower curtain rod assembly suspends the shower curtain thereby to essentially cover the front lip of the bathtub basin during non-use of the basin, and whereby the shower curtain rod assembly provides suspended mobility of the shower curtain in order to provide obstruction-free cleaning of the bathtub basin.

2. The Shower Curtain Rod Assembly as in claim 1 wherein the inner surface of the shower curtain rod assembly has an integral threaded portion near the wall end of each straight extension and Y-extension, and wherein said mounting means comprises a plurality of matchingly threaded end caps such that an endcap may be screwed into each wall ends and then unscrewed as needed to suspend the shower curtain rod assembly between two side walls of the alcove above the front lip of the bathtub basin, each endcaps also having an endcap wall end.

3. The Shower Curtain Rod Assembly as in claims 1 or 2, wherein said hanging means comprises a plurality of clips, each clip having a base, a stem and integral securing means for securing the conventional shower curtain, said base being elongated such that said base may be passed through said narrow continuous track opening and then be rotated such that said base is supported by the inner surface of the shower curtain rod assembly, said stem being integral to said clip and abutting said base such that the shower curtain is not obstructed as the shower curtain is extended along the shower curtain rod.

4. The Shower Curtain Rod Assembly as in claim 3, wherein said integral securing means is selected from the group consisting of hooks, clamps and split rings.

5. The Shower Curtain Rod Assembly as in claim 4, wherein each endcap further comprises a wall protector, each wall protector being essentially flat and composed of a skid resistant material, each wall protector being affixed to the endcap wall end of the endcap and separating a side wall from and endcap wall end, thereby protecting the sidewall and more reliably suspending the shower curtain rod, the wall protector being composed of a material selected from the group consisting of rubber and plastic.

* * * * *